US010080412B2

(12) United States Patent
Hartmann et al.

(10) Patent No.: US 10,080,412 B2
(45) Date of Patent: Sep. 25, 2018

(54) TELESCOPIC HANDLE FOR PIECE OF LUGGAGE

(71) Applicant: SUDHAUS GmbH & Co. KG, Iserlohn (DE)

(72) Inventors: Michael Hartmann, Iserlohn (DE); Peter Schulte, Sundern (DE); Benjamin Beckmann, Iserlohn (DE)

(73) Assignee: SUDHAUS GMBH & CO. KG, Iserlohn (DE)

( * ) Notice: Subject to any disclaimer, the term of this patent is extended or adjusted under 35 U.S.C. 154(b) by 0 days.

(21) Appl. No.: 15/316,050

(22) PCT Filed: May 22, 2015

(86) PCT No.: PCT/EP2015/001054

§ 371 (c)(1),
(2) Date: Dec. 2, 2016

(87) PCT Pub. No.: WO2015/192938

PCT Pub. Date: Dec. 23, 2015

(65) Prior Publication Data

US 2017/0112250 A1 Apr. 27, 2017

(30) Foreign Application Priority Data

Jun. 18, 2014 (DE) ..... 10 2014 009 073

(51) Int. Cl.
*A47B 95/02* (2006.01)
*A45C 13/26* (2006.01)

(52) U.S. Cl.
CPC ..... *A45C 13/262* (2013.01); *A47B 95/02* (2013.01); *A45C 2013/267* (2013.01)

(58) Field of Classification Search
CPC . A45C 13/26; A45C 13/262; A45C 2013/226; A45C 2013/267; A47B 95/02; B62B 1/12; B62B 1/125; B62B 2202/24
USPC ..... 16/113.1, 405
See application file for complete search history.

(56) References Cited

U.S. PATENT DOCUMENTS 5,581,846 A * 12/1996 Wang ..... A45C 13/262 16/113.1
5,584,097 A * 12/1996 Lu ..... A45C 5/14 16/113.1
5,653,000 A * 8/1997 Lee ..... A45C 13/262 16/113.1
5,692,266 A * 12/1997 Tsai ..... A45C 13/262 16/113.1

(Continued)

FOREIGN PATENT DOCUMENTS

DE 102012013612 A 1/2014

*Primary Examiner* — Roberta S Delisle
(74) *Attorney, Agent, or Firm* — Andrew Wilford

(57) ABSTRACT

A telescopic handle for a piece of luggage has telescoping inner and outer tubes. A rod fixed on the outer tube has a toothed lower end, a toothed upper end spaced above the toothed lower end, and an untoothed sliding section between the upper and lower ends. The outer end of the inner tube carries a grip and the outer tube is fixed in the piece of luggage. A handle on the grip can be actuated to shift a locking element in the inner tube between a locking position engaging the upper or lower end of the rod of the outer tube and preventing relative movement of the inner and outer tubes and a freeing position permitting such movement.

11 Claims, 5 Drawing Sheets

(56) References Cited

U.S. PATENT DOCUMENTS

| | | | | | |
|---|---|---|---|---|---|
| 5,727,898 | A * | 3/1998 | Lu | A45C 13/262 | 16/113.1 |
| 5,806,143 | A * | 9/1998 | Tsai | A45C 13/262 | 16/405 |
| 6,026,542 | A * | 2/2000 | Lu | A45C 13/262 | 16/113.1 |
| 6,026,543 | A * | 2/2000 | Chen | A45C 13/262 | 16/113.1 |
| 6,081,967 | A * | 7/2000 | Chang | A45C 13/262 | 16/113.1 |
| 6,161,253 | A * | 12/2000 | Tu | A45C 13/262 | 16/113.1 |
| 6,223,392 | B1 * | 5/2001 | Chang | A45C 13/262 | 16/113.1 |
| 6,295,698 | B1 * | 10/2001 | Chang | A45C 13/262 | 16/113.1 |
| 6,332,241 | B1 * | 12/2001 | Kuo | A45C 13/262 | 16/113.1 |
| 6,357,080 | B1 * | 3/2002 | Tsai | A45C 13/262 | 16/113.1 |
| 6,470,529 | B1 * | 10/2002 | Chang | A45C 13/262 | 16/113.1 |
| 6,581,737 | B2 * | 6/2003 | Wang | B25B 9/00 | 16/113.1 |
| 2003/0009848 | A1 * | 1/2003 | Kuo | A45C 13/262 | 16/113.1 |
| 2003/0009853 | A1 | 1/2003 | Kuo | | |
| 2004/0177475 | A1 | 9/2004 | Lau | | |
| 2006/0225981 | A1 * | 10/2006 | Lin | A45C 13/262 | 190/115 |

* cited by examiner

TELESCOPIC HANDLE FOR PIECE OF LUGGAGE

CROSS REFERENCE TO RELATED APPLICATIONS

This application is the US-national stage of PCT application PCT/EP2015/050921 filed 20 Jan. 2015 and claiming the priority of German patent application 102014101746.3 itself filed 12 Feb. 2014.

FIELD OF THE INVENTION

The invention relates to a telescopic handle for a piece of luggage, in particular a travel suitcase, having an outer telescopic tube fixed on the piece of luggage, an inner telescopic tube that can be recessed in and pulled out of the outer telescopic tube, and a grip on the end of the inner telescopic tube that can be pulled out of the outer telescopic tube such that the telescopic handle can be adjusted from a rest position, in which the inner telescopic tube is recessed in the outer telescopic tube, to an operating position in which the inner telescopic tube is pulled out of the outer telescopic tube and the piece of luggage can be moved and steered by the telescopic handle.

A piece of luggage, in particular a travel suitcase, is nowadays usually fitted with rollers and with a telescopic handle for easily moving the piece of luggage. These telescopic or pull-out handles have gained acceptance because on the one hand when the piece of luggage is to be stowed, it can be inserted in a space-saving manner into the piece of luggage and on the other hand, when the piece of luggage is to be moved, it can be pulled out to a certain length. The advantage of these telescopic handles lies in the fact that they can be adjusted independently of the size of the respective piece of luggage to a comfortable handle height for the respective user. In order to bring the telescopic handle into its operating position in which the piece of luggage can be moved and maneuvered, the telescopic handle is pulled out manually and the telescopic handle is retracted manually to bring it back into the rest position.

OBJECT OF THE INVENTION

Starting from the previously described prior art, it is the object of the invention to further develop the generic telescopic handle for a piece of luggage, in particular a travel suitcase in such a manner that its operating comfort is increased considerably without changing its external dimensions.

SUMMARY OF THE INVENTION

This object is attained according to the invention in that the telescopic handle has a positioning and energy-storage device that can move the inner telescopic tube from a position that corresponds to the rest position of the telescopic handle and in which the inner telescopic tube is recessed in the outer telescopic tube to an intermediate position in which the inner telescopic tube is partially pulled out of the outer telescopic tube and the grip on the inner telescopic tube can be comfortably grasped and from which the grip can be brought into the operating position of the telescopic handle and that the positioning and energy-storage device is integrated inside the outer and inner telescopic tube of the telescopic handle. In the case of the telescopic handle configured according to the invention, in the rest position of the telescopic handle, the grip connected to the inner telescopic tube can be recessed completely in a fixed handle guide housing in relation to the outer telescopic tube since manual actuation of this grip as such is not necessary in the rest position of the telescopic handle. The positioning and energy-storage device provided according to the invention can bring the inner telescopic tube and with this the grip fixed on the inner telescopic tube into the intermediate position in which the grip can be easily handled in the usual manner. By integrating the positioning and energy-storage device in the space formed inside the telescopic tubes of the telescopic handle, the dimensions of the telescopic handle are not increased as a result of the presence of the positioning and energy-storage device.

In particular in the case of a comparatively small travel suitcase or items of luggage, it is advantageous if an intermediate telescopic tube is between the inner telescopic tube and the outer telescopic tube. The intermediate telescopic tubes are usually connected to the respective inner and outer telescopic tubes. As a result of the presence of the intermediate telescopic tube, the operating position of the telescopic handle can be adjusted over a larger longitudinal range.

Expediently a positioning and energy-storage device is provided for each telescopic tube of the inner telescopic tube. This results in an equalization of the forces that must be exerted and transmitted between the individual telescopic tubes of the telescopic handle.

According to an advantageous further development of the telescopic handle according to the invention, the positioning and energy-storage device thereof can be actuated by a handle adjustably mounted on the grip so that a locking element in the inner telescopic tube can be moved into and out of engagement with a locking member in the outer telescopic tube or in the intermediate telescopic tube.

Advantageously the locking member in the outer telescopic tube or in the intermediate telescopic tube, preferably pressed into the outer telescopic tube or into the intermediate telescopic tube can be a lower end section of a toothed rod extending along the outer telescopic tube or the intermediate telescopic tube, the toothed rod having the lower end section with which the locking element in the inner telescopic tube is in engagement in the rest position of the telescopic handle, a sliding section that extends above the lower end section of the toothed rod and in which the locking element in the inner telescopic tube cannot engage, and an upper section that extends above the sliding section of the toothed rod and in which the locking arrangement in the inner telescopic tube can engage quasi-continuously.

In order to achieve the locking in a mechanically constructively comparatively simple manner, it is proposed that the locking element in the inner telescopic tube is pretensioned toward the toothed rod and can be moved out of engagement with the toothed rod by an actuator connected to the handle on the grip side. When in the rest position of the telescopic handle accordingly the engagement between the locking element on the grip side and the toothed rack is cancelled by the handle, the positioning and energy-storage device of the telescopic handle is automatically put into operation, by which the inner telescopic tube is raised from the outer telescopic tube or from the intermediate telescopic tube Advantageously the actuator is connected to the handle on the grip side by a tension means and can be moved in the longitudinal direction of the inner telescopic tube wherein the actuator furthermore has an angled face arrangement by means of which the longitudinal movement can be converted into an adjustment of the locking element in the inner telescopic tube directed in the transverse direction of the inner telescopic tube, by means of which the locking element in the inner telescopic tube can be moved out of engagement with the toothed rod.

According to a particularly advantageous embodiment of the telescopic handle according to the invention, a tilting lever is pivotable by the handle thereof, by means of which the actuator is movable in the longitudinal direction of the inner telescopic tube by the tension means.

In order to be able to adjust or displace the actuator connected to the locking element in a defined manner, it is proposed that the actuator is displaceable in an adjusting chamber firmly inserted in the inner telescopic tube, preferably pressed in.

The positioning and energy-storage device of the telescopic handle according to the invention advantageously comprises a compression spring that in the rest position of the telescopic handle is compressed between the inner telescopic tube and the outer telescopic tube or the intermediate telescopic tube. By this means, on the one hand the possibility is afforded that upon release of the compression spring, the inner telescopic tube is raised by a pre-definable stroke from the outer telescopic tube or from the intermediate telescopic tube, wherein furthermore in a mechanically constructive less complex manner, possibilities can be achieved by means of which the compression spring can be compressed in a suitable manner when pushing together the telescopic handle.

Advantageously the compression spring of the positioning and energy-storage device of the telescopic handle according to the invention holds a drive or lifting rod that in the rest position of the telescopic handle can be clamped between the tensioned compression spring and the outer telescopic tube or the intermediate telescopic tube.

Advantageously by the compression spring, after cancelling the engagement between the locking element in the inner telescopic tube and the lower section of the toothed rod in the outer telescopic tube or in the intermediate telescopic tube, the inner telescopic tube can be raised from the outer telescopic tube or the intermediate telescopic tube by a stroke length corresponding to the length of the sliding section of the toothed rod and the locking element. This ensures that the locking element on the grip side comes into engagement with the upper section of the toothed rod, wherein in this position of the locking element on the grip side and therefore of the grip, the telescopic handle adopts its intermediate position.

The stroke length is advantageously about 20 mm.

BRIEF DESCRIPTION OF THE DRAWING

The invention is explained in detail hereinafter by an embodiment with reference to the drawings. In the figures.

SPECIFIC DESCRIPTION OF THE INVENTION

Figure 1:
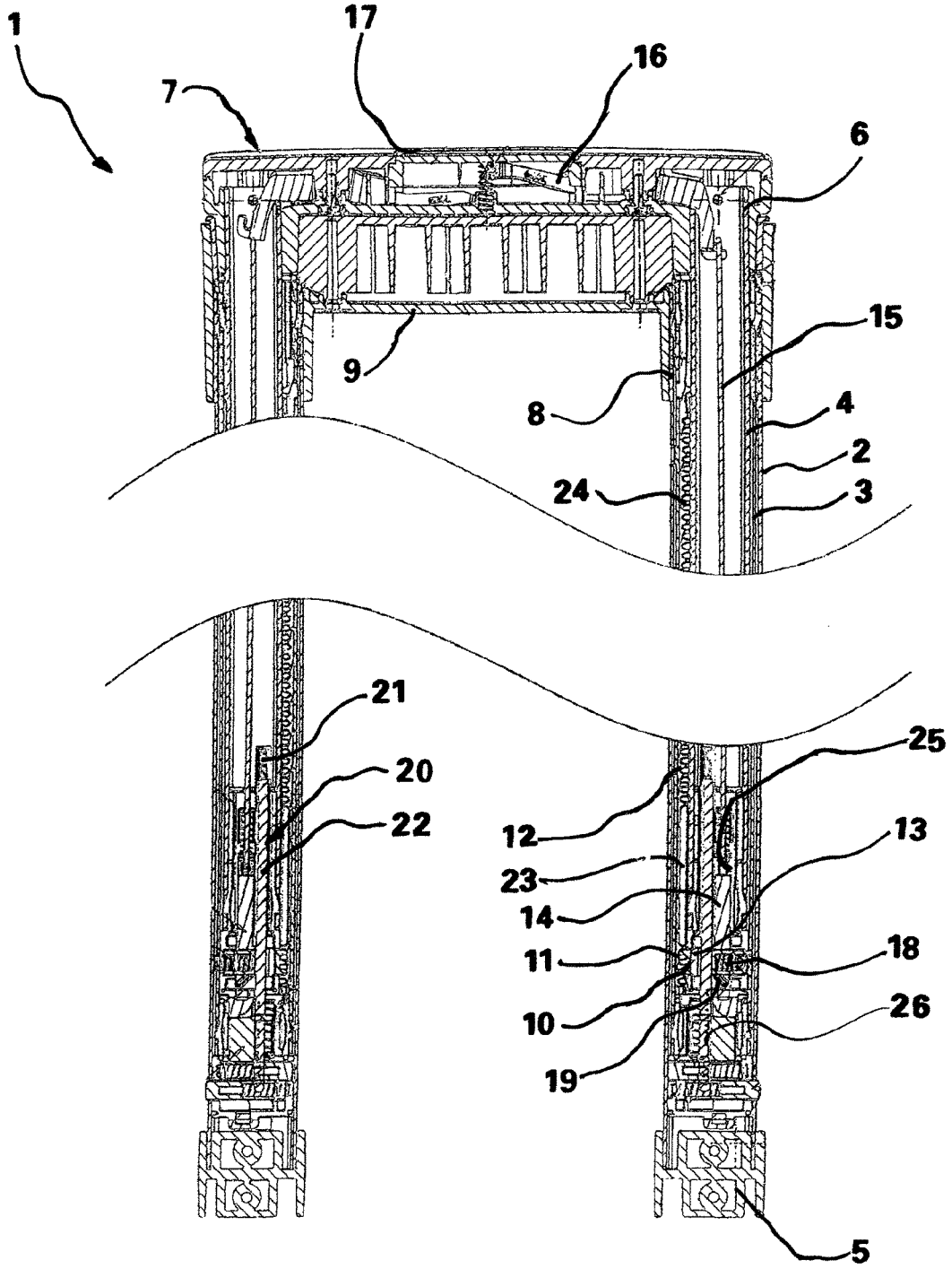
FIG. 1 is a section through one embodiment of the telescopic handle according to the invention for a piece of luggage in which the telescopic handle is in the rest position.

A telescopic handle 1, also called pull-out handle, according to the invention, shown in different positions in FIGS. 1 to 5 and explained hereinafter, is used to move a piece of luggage, in particular a travel suitcase or similar container, not shown in the figures.

In the embodiment shown, the telescopic handle 1 has an outer telescopic tube formed of two outer telescopic tubes 2, a intermediate telescopic tube or intermediate telescopic tube formed of two intermediate telescopic tubes 3 with each intermediate telescopic tube 3 inside a respective one of the outer telescopic tubes 2, and an inner telescopic tube formed from two inner telescopic tubes 4 with the inner telescopic tube 4 inside a respective one of the intermediate telescopic tubes 3.

The intermediate telescopic tubes 3 are connected to the respective outer telescopic tubes 2 or inner telescopic tubes 4 in a telescopic manner so that they can be pulled out and pushed in.

The two outer telescopic tubes 2 are fixed on the piece of luggage by spacers 5.

The two inner telescopic tubes 4 are connected to one another by a grip 7 at the ends 6 thereof and can be pulled out from the outer telescopic tubes 2.

The two outer telescopic tubes 2 are—as already mentioned—fixed to the piece of luggage not shown in FIGS. 1 to 5. At upper ends 8 thereof in FIGS. 1 to 5, the two outer telescopic tubes 2 are connected to one another by a handle guide housing 9, and in a rest position of the telescopic handle 1 in which the inner telescopic tubes 4 and the intermediate telescopic tubes 3 are recessed inside the outer telescopic tubes 2, the grip 7 of the telescopic handle 1 is recessed in the handle guide housing 9 of the same.

The grip 7 of the telescopic handle 1 can be locked by a latch 10 in or on the handle guide housing 9.

To this end, the latch 10 comprises a locking member 11 fixed in the intermediate telescopic tube 3 in the embodiment shown. In the embodiment shown the locking member 11 fixed in or on the intermediate telescopic tube 3 is a lower end section of a toothed rod 12 that extends internally in the longitudinal direction of the intermediate telescopic tube 3. Furthermore, the latch 10 includes a locking element 13 that can be brought into and out of engagement with the lower end section 11 of the toothed rod 12 forming the locking member.

The locking element 13 is carried on an actuator 14 connected via a tension means 15 that extends through the telescopic tube and a tilting lever 16 to a handle 17 recessed on the grip 7

The locking element 13 is pretensioned by a transverse spring 18 toward the toothed rod 12. An angled face arrangement 19 is provided on the actuator 14. When the actuator 14 is raised by actuating the handle 17 on the grip side via the tilting lever 16 and the tension means 15, the actuator 14 and with it the locking element 13 is moved by the angled face arrangement 19 against the spring force of the transverse spring 18 radially of the telescopic tube so that the locking element 13 comes out of engagement with the lower end section 11 of the toothed rod 12. As soon as the locking element 13 connected to the grip 7 via the tension means 15 disengages from the lower end section 11 of the toothed rod 12 fixed in the intermediate telescopic tube 3, the inner telescopic tube 4 is movable in the intermediate telescopic tube 3.

In order to bring the grip 7 recessed inside or on the handle guide housing 9 in the rest position of the telescopic handle 1 into an intermediate position in which the grip 7 is readily grasped, the telescopic handle 1 has a positioning and energy-storage device 20. This positioning and energy-storage device 20 includes a compression spring 21 on the inner telescopic tube 4 and on which a lifting or drive rod 22 is fixed.

In the rest position of the telescopic handle 1 shown in FIG. 1 the positioning and energy-storage device 20 comprising the compression spring 21 and the lifting or drive rod 22 is fixed between the inner telescopic tube 4 and the intermediate telescopic tube 3 when the compression spring 21 is compressed. In the rest position of the telescopic handle 1, the lifting or drive rod 22 abuts with its lower end against a stop 26 provided in the intermediate telescopic tube 3. As soon as the locking element 13 connected to the grip 7 is disengaged from the lower section 11 of the toothed rod 12 connected to the intermediate telescopic tube 3, the inner telescopic tube 4 is displaced upward by the mechanical energy stored in the compression spring 21 of the positioning and energy-storage device 20.

Since the toothed rod 12 is formed with a toothing-free sliding section 23 above its lower end section 11, after cancelling the engagement between locking element 13 on the grip side and the locking member 11 provided on the intermediate telescopic tube 3, the actuation of the handle 17 need not be maintained.

The grip 7 is moved upward as a result of the interaction between the positioning and energy-storage device 20 and the intermediate telescopic tube 3 or the stop 26 provided therein until the locking element 13 on the grip side is pushed directly above the sliding section 23 of the toothed rod 12 by the transverse spring 18 again into engagement with a toothed upper section 24 of the toothed rod 12.

Figure 2:
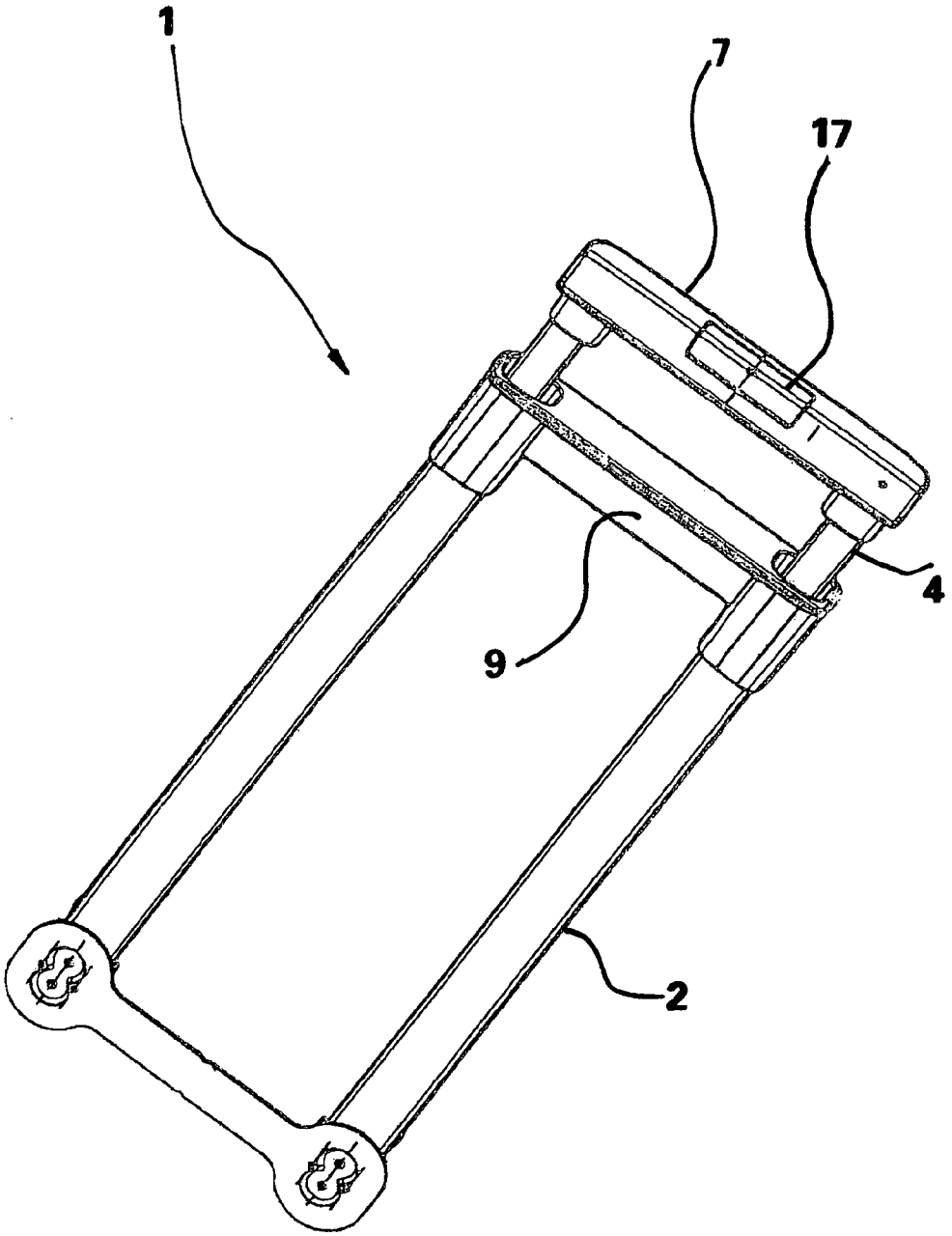
FIG. 2 is a view of the embodiment of the telescopic handle according to the invention shown in FIG. 1 where an inner telescopic tube of the telescopic handle is in an intermediate position.
Figure 3:
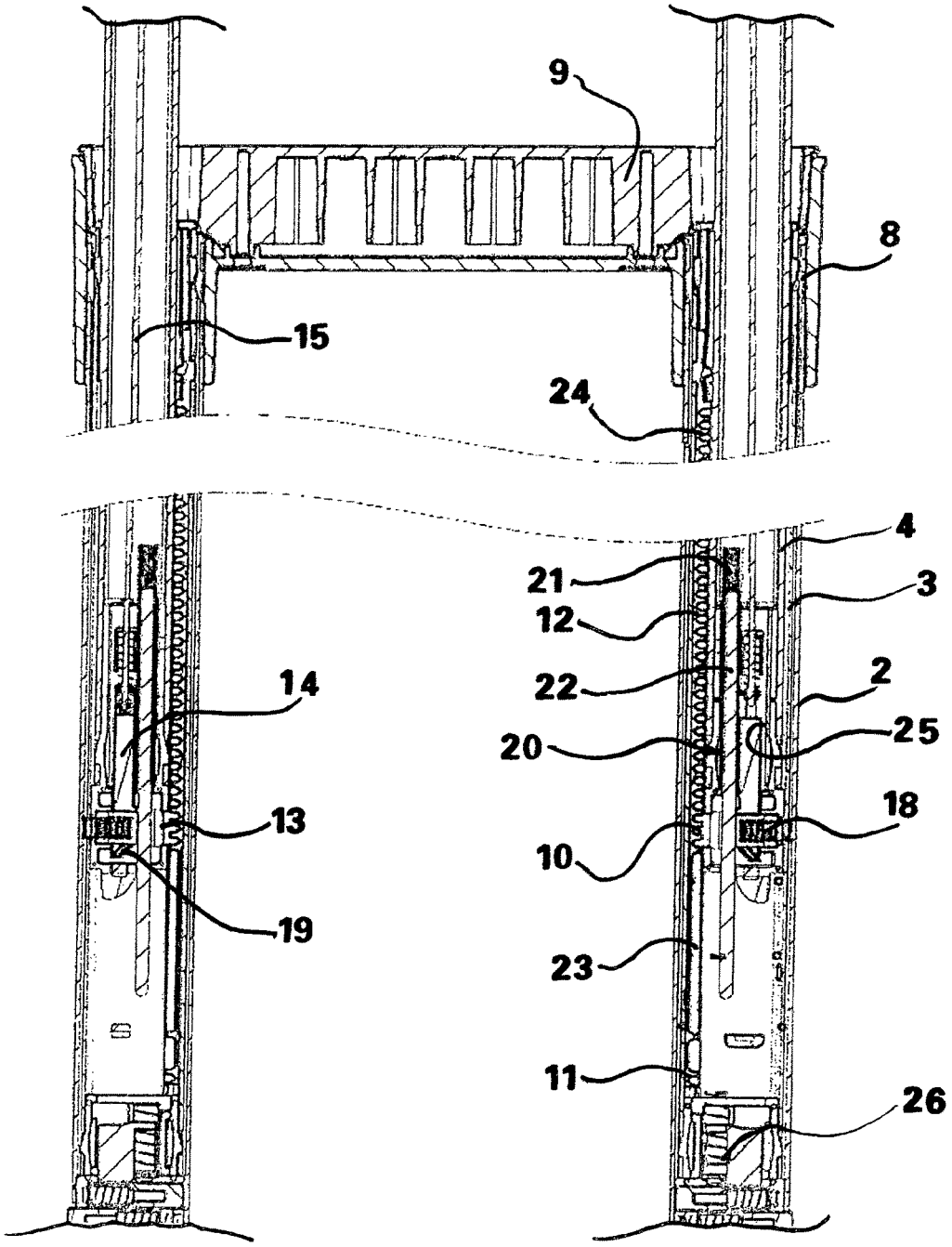
FIG. 3 is a sectional view of a positioning and energy-storage device of the telescopic handle according to the invention in the intermediate position shown in FIG. 2.

By actuating the handle 17 on the grip side once, the telescopic handle 1 can accordingly be brought from its rest position shown in FIG. 1 into its intermediate position shown in FIGS. 2 and 3 so that the grip 7 of the telescopic handle 1 is moved away from the handle guide housing 9 of the telescopic handle 1 by a pre-definable stroke and thus can be grasped in a simple and convenient manner.

Figure 4:
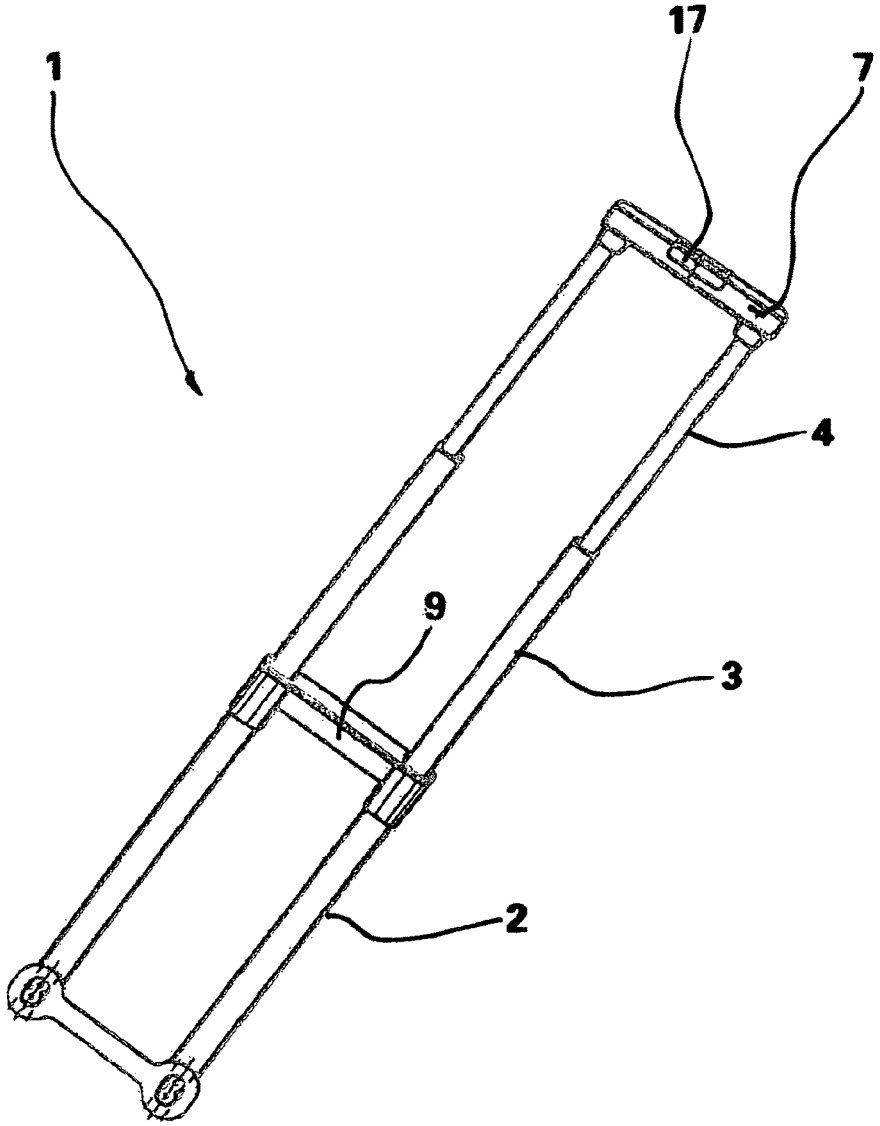
FIG. 4 is a view of the embodiment of the telescopic handle according to the invention shown in FIGS. 1 to 3 with the inner telescopic tube in its completely pulled-out position.
Figure 5:
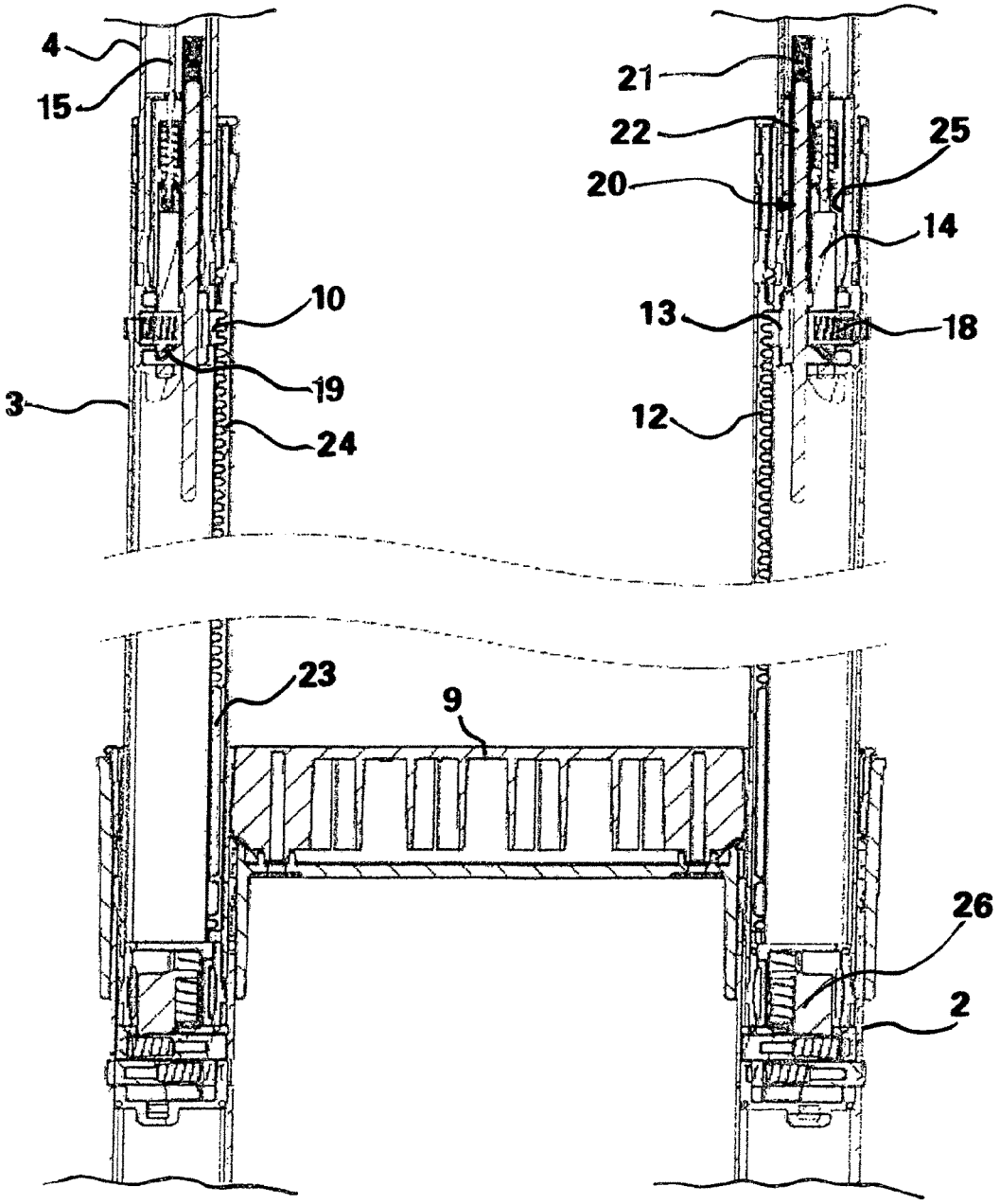
FIG. 5 is a sectional view of the positioning and energy-storage device of the telescopic handle shown in FIGS. 1 to 4 in the pulled-out end position of the inner telescopic tube.

If the telescopic handle 1 is to be moved from the intermediate position shown in FIGS. 2 and 3 into a pulled-out operating position shown in FIGS. 4 and 5, the the toothed upper section 24 of the toothed rod can be disengaged again by renewed actuation of the handle. By this means the inner telescopic tube 4 is movable relative to the outer telescopic tube 2 until the operator has found a suitable operating position of the telescopic handle 1 for him and ends the actuation of the handle 17. In this operating position the the locking element 13 on the grip side re-engages the corresponding part of the upper section 24 of the toothed rod 12. The telescopic handle 1 is now located in the operating position selected by the operator. In FIGS. 4 and 5 the selected operating position of the telescopic handle 1 is selected so that the locking element 13 on the grip side at an upper end section of the toothed rod 12 is in engagement with same. Naturally other operating positions of the telescopic handle 1 are also possible. The adjustable handle 1 is adjustable quasi-continuously between different operating positions according to the dimensions of the upper section 24 of the toothed rod 12.

In order to ensure a defined sequence of the adjustment of the actuator 14 brought about by the handle 17 on the grip side, the actuator 14 is displaceably recessed inside an adjusting chamber 25 firmly inserted or pressed in the inner telescopic tube 4.

In order to bring or push the telescopic handle 1 from the operating position shown in FIGS. 4 and 5 back into the rest position shown in FIG. 1, the handle 17 on the grip side must be actuated for the duration of the push-in process so that the locking element 13 on the grip side is loosened or released from its locking with the upper section 24 of the toothed rod 12. In this state the inner telescopic tube 4 and the intermediate telescopic tube 3 can be pushed back again into the outer telescopic tube 2. As a result of the simultaneous application of force to the grip 7 toward the telescopic insertion as far as the stop, the positioning and energy-storage device 20 or its compression spring 21 is pretensioned again. On reaching the end position of the telescopic handle 1 defined by a stop, the actuation of the handle 17 is ended so that the locking element 13 on the grip side is brought into engagement with the locking member or the lower end section 11 of the toothed rod 12.

The telescopic handle 1 has the same type of functional members in both telescopic tubes in both inner telescopic tubes 4. intermediate telescopic tubes 3 and outer telescopic tubes 2, wherein hereinbefore the description and operating mode have been made for one outer telescopic tube 2, intermediate telescopic tube 3 and inner telescopic tube 4.

The invention claimed is:

1. A telescopic handle for a piece of luggage, the handle comprising:

an outer longitudinally extending telescopic tube fixed on the piece of luggage;

a longitudinal rod fixed on the outer telescopic tube and having a toothed lower end, a toothed upper end spaced above the toothed lower end, and an untoothed sliding section between the upper and lower ends;

an inner longitudinally extending telescopic tube that can be accommodated in and pulled longitudinally out of the outer telescopic tube;

a grip on an outer end of the inner telescopic tube that can be pulled out of the outer telescopic tube to shift the telescopic handle between a rest position in which the inner telescopic tube is recessed in the outer telescopic tube and an operating position in which the inner telescopic tube is pulled out of the outer telescopic tube and the piece of luggage can be moved and steered by the telescopic handle;

a positioning and energy-storage device that can move the inner telescopic tube from a position that corresponds to the rest position of the telescopic handle and in which the inner telescopic tube is in the outer telescopic tube to an intermediate position in which the inner telescopic tube is slightly pulled out of the outer telescopic tube and the grip on the inner telescopic tube can be comfortably grasped by a hand and from which the grip can be brought into the operating position of the telescopic handle, the positioning and energy-storage device being integrated inside the outer and inner telescopic tubes of the telescopic handle; and a handle on the grip;

a locking element in the inner telescopic tube shiftable by the handle between a locking position engaging the upper or lower end of the rod of the outer telescopic tube and preventing relative telescopic movement of the inner and outer telescopic tubes and a freeing position permitting such movement.

2. The telescopic handle according to claim 1, wherein the outer telescopic tube includes:

a longitudinally extending intermediate telescopic tube between the inner telescopic tube and the outer telescopic tube.

3. The telescopic handle according to claim 1, further comprising:

pretensioning means for transversely urging the locking element in the inner telescopic tube toward the toothed rod; and an actuator connected between the grip and the locking element for moving the locking element transversely out of engagement with the rod.

4. The telescopic handle according to claim 3, further comprising:

a tension spring connecting the actuator to the handle biasing the actuator longitudinally in the inner telescopic tube; and an angled face on the actuator engageable with the locking element converts longitudinal movement of the actuator into transverse movement of the locking element in the inner telescopic tube so as to move the locking element in the inner telescopic tube out of engagement with the toothed rod.

5. The telescopic handle according to claim 4, further comprising:

a pivotal tilting lever connecting the actuator with the tension spring.

6. The telescopic handle according to claim 3, wherein the actuator is displaceable in an adjusting chamber firmly inserted in the inner telescopic tube, preferably pressed in.

7. The telescopic handle according to claim 1, wherein the positioning and energy-storage device has a compression spring that in the rest position of the telescopic handle is compressed between the inner telescopic tube and the outer telescopic tube.

8. The telescopic handle according to claim 7, wherein the compression spring holds a drive or lifting rod that in the rest position of the telescopic handle can be clamped between the tensioned compression spring and the outer telescopic tube.

9. The telescopic handle according to claim 7, wherein by the compression spring, after disengaging the locking element in the inner telescopic tube from the lower end of the toothed rod in the outer telescopic tube, the inner telescopic tube can be raised from the outer telescopic tube or the intermediate telescopic tube a stroke corresponding to a length of the sliding section of the toothed rod and the locking element.

10. The telescopic handle according to claim 9, wherein the stroke is about 20 mm.

11. The telescopic handle according to claim 1, wherein the toothed upper end is longitudinally significantly longer than the toothed lower end of the rod, whereby the handle can be locked in a plurality of longitudinally offset positions by engagement of the locking element in teeth of the upper end.

* * * * *